US008408839B2

(12) United States Patent
Casters

(10) Patent No.: US 8,408,839 B2
(45) Date of Patent: Apr. 2, 2013

(54) MACHINE FOR LAYING CONCRETE PATHS

(75) Inventor: François Joseph Casters, Opglabbeek (BE)

(73) Assignee: B.V.B.A. Consulting Casters, Opglabbeek (BE)

( * ) Notice: Subject to any disclaimer, the term of this patent is extended or adjusted under 35 U.S.C. 154(b) by 102 days.

(21) Appl. No.: 12/739,053

(22) PCT Filed: Oct. 10, 2008

(86) PCT No.: PCT/EP2008/008576

§ 371 (c)(1),
(2), (4) Date: Jun. 7, 2010

(87) PCT Pub. No.: WO2009/046990

PCT Pub. Date: Apr. 16, 2009

(65) Prior Publication Data

US 2011/0129297 A1 Jun. 2, 2011

(30) Foreign Application Priority Data

Oct. 12, 2007 (NL) ..... 1034504

(51) Int. Cl.
*E01C 19/12* (2006.01)

(52) U.S. Cl. ..... 404/104; 404/118

(58) Field of Classification Search ..... 404/72, 404/75, 83–98, 104, 105, 108, 110, 114, 404/118

See application file for complete search history.

(56) References Cited

U.S. PATENT DOCUMENTS

| | | | | |
|---|---|---|---|---|
| 2,796,811 | A | 6/1957 | Barber et al. | |
| 3,743,432 | A * | 7/1973 | Lee | 404/84.1 |
| 4,678,365 | A | 7/1987 | Ban et al. | |
| 5,509,753 | A * | 4/1996 | Thompson | 404/6 |
| 7,651,295 | B2 * | 1/2010 | Eppes et al. | 404/118 |

FOREIGN PATENT DOCUMENTS

WO 95/28525 10/1995

OTHER PUBLICATIONS

International Search Report issued Feb. 13, 2009 in International (PCT) Application No. PCT/EP2008/008576.
Written Opinion of the International Searching Authority issued Feb. 13, 2009 in International (PCT) Application No. PCT/EP2008/008576.

* cited by examiner

*Primary Examiner* — Raymond W Addie
(74) *Attorney, Agent, or Firm* — Dinsmore & Shohl LLP

(57) ABSTRACT

A machine for laying concrete paths of the type in which a concrete mix in the plastic state is spread over a certain width and is then levelled to a certain height, in which a levelling element comprises at least two largely horizontal plates which are positioned at least partially laterally next to one another, viewed in the direction of movement of the machine, and which can be displaced in the lateral direction relative to one another for adjusting the working width of the machine, and in which the first plate bears with its lower face against the upper face of the second plate.

19 Claims, 4 Drawing Sheets

MACHINE FOR LAYING CONCRETE PATHS

Figure 1:
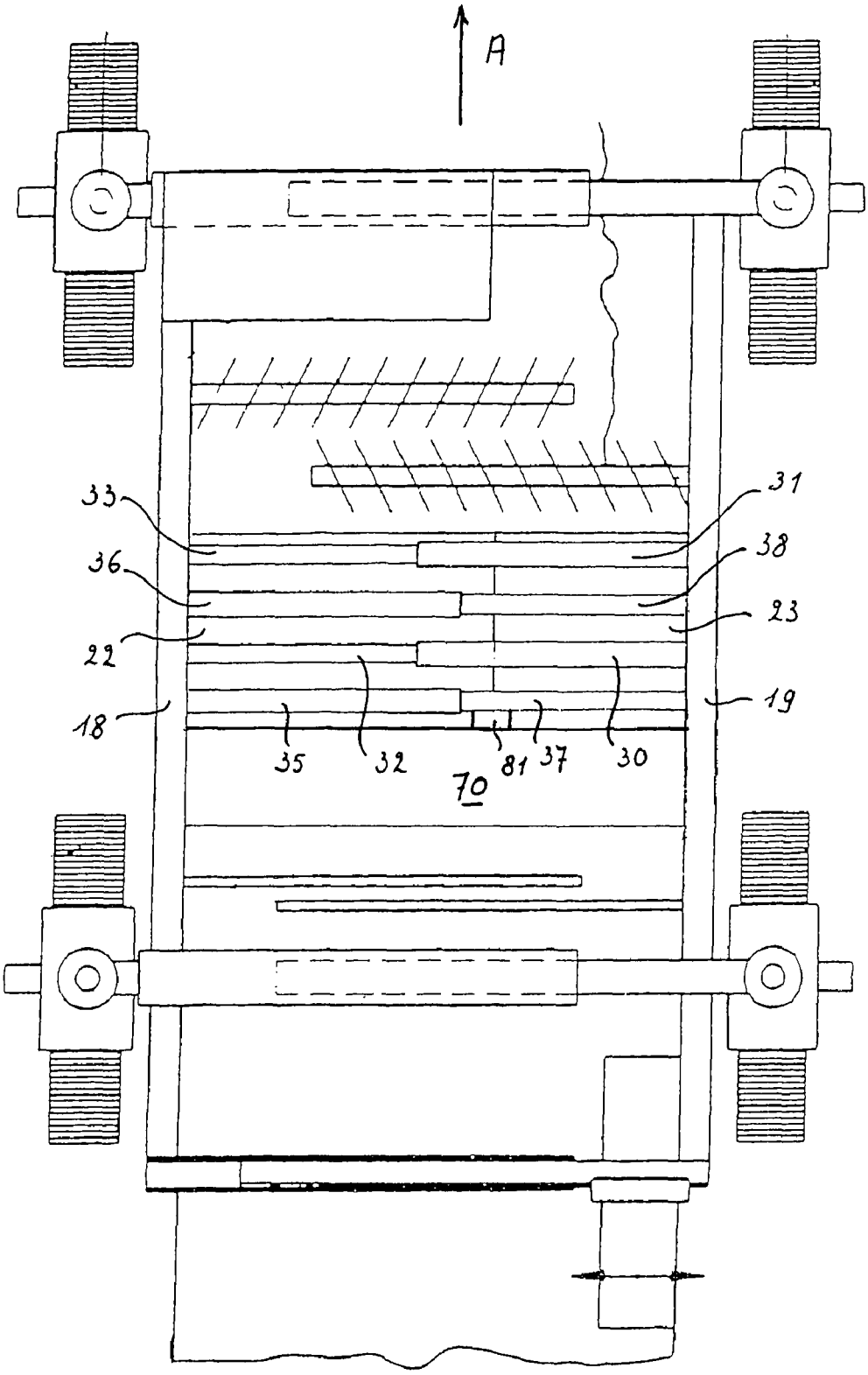

The invention relates to a machine for laying concrete paths of the type in which a concrete mix in the plastic state is spread over a certain width, then levelled at a certain height, and in which the a levelling element comprises at least two largely horizontal plates which are positioned at least partially laterally next to one another viewed in the direction of movement of the machine, and which can be displaced in the lateral direction relative to one other for adjusting the working width of the machine.

Such a machine is known from the International patent application WO-95/28525.

In this machine of prior art the levelling plates are only positioned so that they partially overlap laterally, viewed in the direction of movement of the machine, but they are also positioned behind one another, viewed in the direction of movement. A sort of seam is therefore formed on the free edge by the last plate viewed in the direction of movement, which seam can be corrected afterwards to obtain a completely level, smooth surface. Moreover, the machine is made longer by this arrangement, thereby reducing its mobility.

The object of the invention is to provide a machine of the type mentioned, in which the disadvantages mentioned are avoided.

This object is achieved according to the invention in that the first plate bears with its lower face against the upper face of the second plate.

Therefore, by allowing the two levelling plates to slide over one another, the difference in height between the two plates is reduced to a minimum, whilst the machine at the same time becomes considerably shorter.

The plates are preferably formed in such a manner that the rear edges of the plates form the lowest line of the plates and the two rear edges lie at the same height, viewed in the direction of movement of the machine.

This provides a completely level, smooth surface which requires no further processing.

In a preferred embodiment the first plate has an oblique downwardly directed rear section which terminates on a rear edge which determines the desired levelling height, and the second plate is also provided with such a downwardly directed rear section, the rear edge of the rear section of the second plate lying at the same height as the rear edge of the rear section of the first plate.

The levelling element preferably consists of three horizontal plates which are positioned at least partially laterally next to one another, viewed in the direction of movement of the machine, the central plate being fixedly connected to the machine in the lateral direction, and the two side plates being laterally displaceable relative to the central plate.

As a result of this arrangement it is possible to allow the plates to be supported by the frame section which also supports the central plate. This enables the machine to work against the edge of a concrete path already laid.

Other characteristics and advantages of the invention will become clear from the following description, in which reference is made to the attached drawings.

Figure 2:
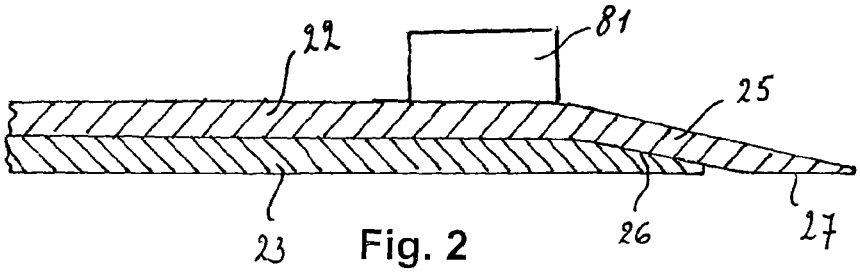
Figure 3:
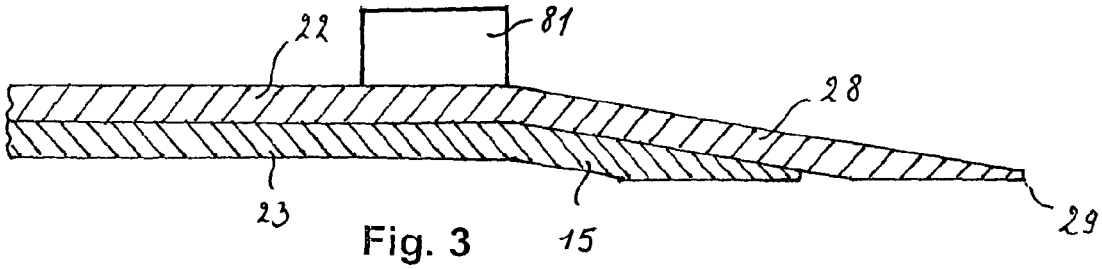
Figure 4:
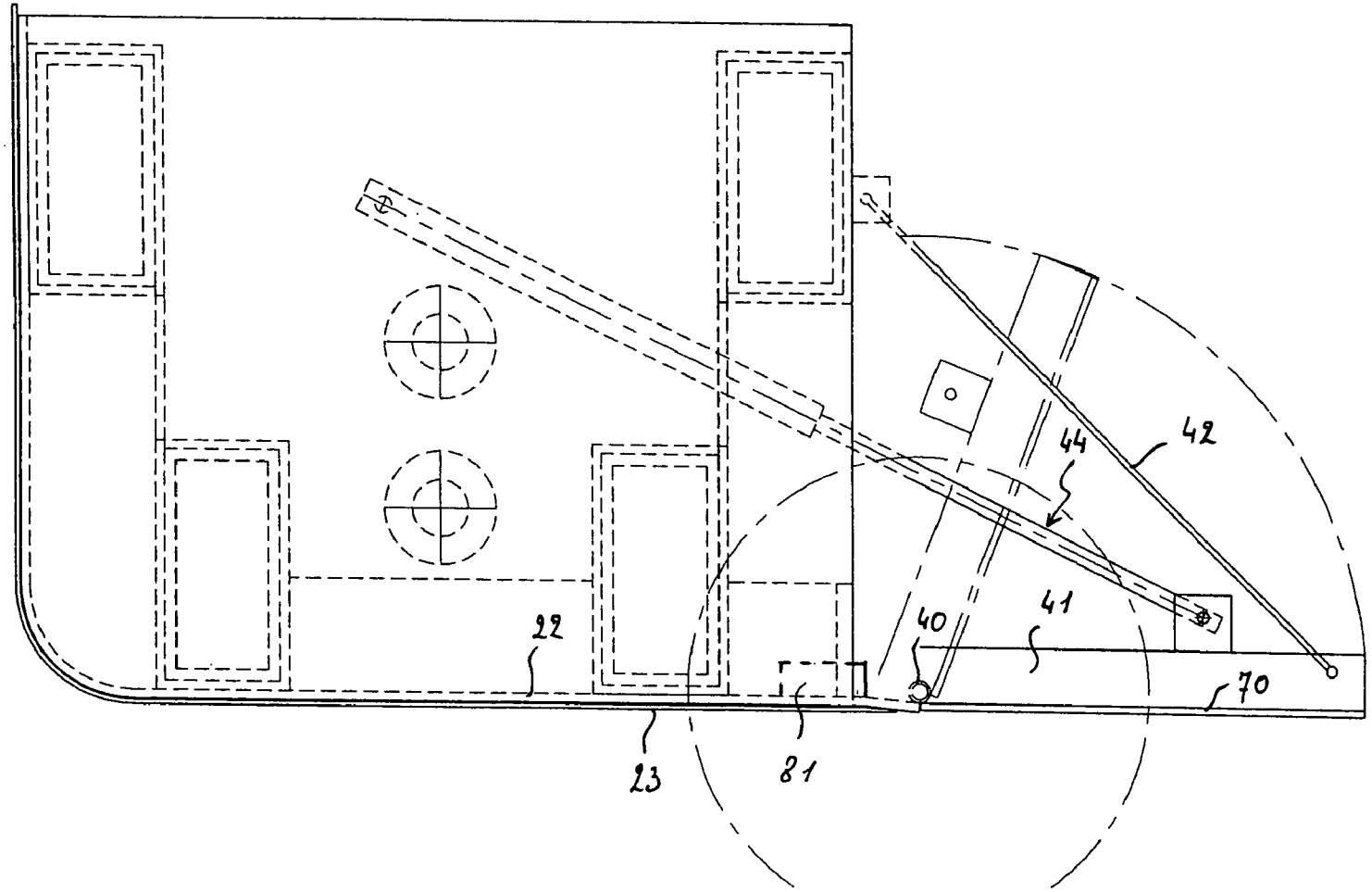
Figure 5:
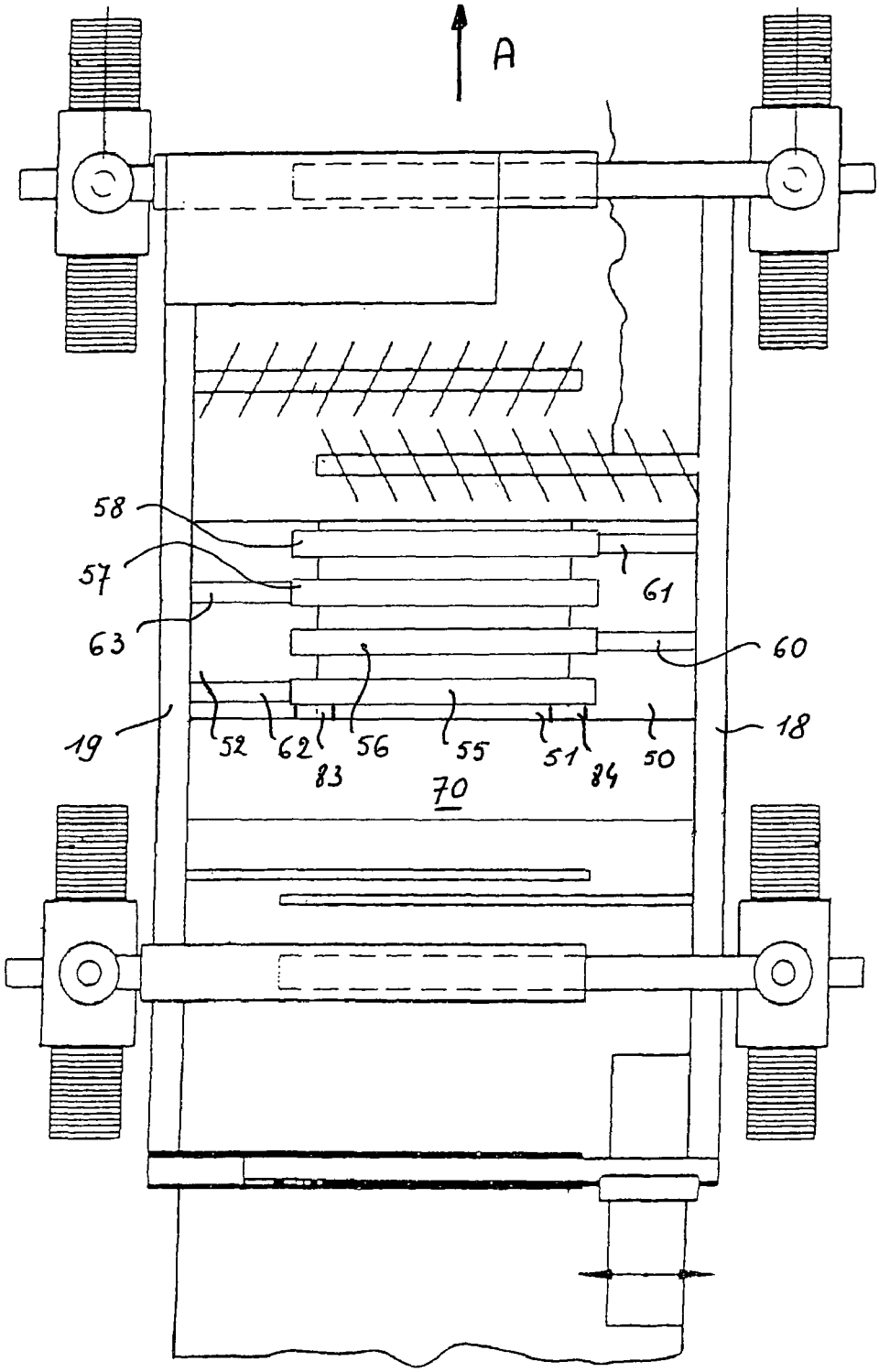

In them:

FIG. 1 shows a diagrammatic elevation of a machine for laying concrete paths, provided with a levelling element according to the invention, FIG. 2 shows a cross-section of the levelling plate along line I-II ion FIG. 1, FIG. 3 shows a cross-section of a modified embodiment of the levelling plate according to the invention, FIG. 4 shows a diagrammatic side view of a finishing plate mounted after the levelling plate, and FIG. 5 shows a diagrammatic elevation of a second embodiment of a machine according to the invention.

The machine shown in FIG. 1 is of the type that was described in detail in the International patent application WO-95/28525, and for further details reference is also made to the description contained therein. The only difference lies in the construction of levelling system 22, 23.

In the embodiment shown in FIG. 1, levelling system 22, 23, consists mainly of two rectangular plates 22, 23 which, viewed in the direction of movement A of the machine, are positioned with one long side at the same distance from the front side of the machine, but in this case plate 22 is positioned slightly higher than plate 23. Here the underside of plate 22 lies against the upper side of plate 23. Plate 22 is in this case connected to frame section 18 and plate 23 is connected to frame section 19, plates 22 and 23 partially overlapping one another viewed in the width direction or lateral direction.

In order to provide plates 22, 23 with sufficient support, plate 23 is connected to two tube sections 30, 31, which are fixedly connected at one end to frame section 19, and where tube sections 32, 33 are incorporated in a sliding manner in tube sections 30, 31, tube sections 32, 33 being fixedly connected to the frame section 18. This therefore forms a telescopically movable tube system in which plate 23 follows the movement of frame section 19, yet sufficient support is provided by the two frame sections.

Plate 22 is supported in the same manner by tube sections 35, 36, one end of which is fixedly connected to frame sections 18, these sections being capable of moving telescopically relative to tube sections 37, 38, one end of which is fixedly connected to frame section 19.

During the widening or narrowing of the machine the plates will therefore follow the movement of frame sections 18, 19 and slide over one another, as a result of which the width of levelling is adapted to the working width of the machine.

A finishing plate 70 is mounted behind the levelling system, viewed in the direction of movement of the machine, which finishing plate extends slightly beyond the maximum width of the machine and serves to spread the top layer of the concrete coat smoothly and level it without any irregularities. This finishing plate 70 follows a course that runs somewhat obliquely to the rear and downwards and is flexibly suspended, as will be described in more detail below with reference to FIG. 4.

In FIG. 2 it is shown in cross-section how the two plates 22, 23 are placed one on top of the other, and the shape of the end sections of the plates is illustrated in more detail. Here end section refers to the section of the plate which is located near the edge which lies at the rear, viewed in the direction of movement of the machine.

The top plate 22 has an end section 25 which is bent obliquely downwards. Plate 23 has an end section that is bevelled on the upper side 26 so that it fits against the lower side of the bent part of end section 25. End 27 of the end section is made horizontal so that the surface of plate 23 is aligned with edge 27 of plate 22.

This structure ensures that plates 22 and 23 are able to slide laterally over one another and can therefore be displaced laterally relative to one another, but also that the levelling height that is achieved by plates 22 and 23 is the same for both plates. This provides a machine which can be designed more compactly because the levelling plates are no longer positioned behind one another but on one another. Moreover, no seam is formed such as that obtained with the machine according to International patent application WO-95/28525 level with the longitudinal edge of the last leveling plate viewed in the direction of movement. This renders the extra step of levelling the seam superfluous. In the embodiment shown, the end lines of plates 22 and 23 are truncated by cutting away the sharp end edge normally formed. This stiffens the structure, whilst the small hole which is formed behind the end edge of plate 23 is so small that no material is able to accumulate in it.

FIG. 3 shows a second embodiment of plates 22 and 23. In this embodiment the top plate 22 has an end section 28 which is bent obliquely downwards so that rear edge 29 projects downwards over a distance that is slightly greater than the thickness of plate 23. In the same manner end section 15 of plate 23 is also bent downwards over such a distance that the rear edge of plate 23 forms the lowest edge located at the same height as the lowest edge of rear edge 29 of plate 22. The lower side of parts 28 and 15 are cut off horizontally at the level of rear edge 29 so that both plates 22 and 23 have a levelling effect located at the same height.

The structure of finishing plate 70 is shown in detail in FIG. 4. At the rear end of plate 22 is mounted a hinge 40 by means of which finishing plate 70 is connected in a hinged manner to finishing plate 22. A number of stiffening ribs 41 are fitted to the upper side of finishing plate 70 to keep late 70 flat. The finishing plate serves to correct minor irregularities that cannot be corrected by the levelling plates and extends over the maximum width of the machine. Here, finishing plate 70 is positioned somewhat obliquely, with its leading edge slightly higher than the trailing edge.

In order to maintain plate 70 in the desired position, a chain or belt 42 is fitted between a frame section 43 which supports the levelling plates 22, 23 at a point on the finishing plate 70 in the vicinity of the rear edge of plate 70. A number of such chains or belts are preferably fitted so that they are distributed over the width of the machine. The inclination of plate 70 can be adjusted by adjusting the length of the belt or chain 42. On the other hand, plate 70 can be folded away, not only for possible maintenance or cleaning, but also if an unexpected obstacle is present in the concrete mass.

In order to apply sufficient pressure to the finishing plate 70, a plunger system 44 is fitted between frame section 43 and plate 70. This system is such that a specific pressure is exerted on plate 70, but also enables the plate to be displaced in the presence of obstacles.

FIG. 5 shows a second embodiment of the machine according to the invention.

The machine according to FIG. 3 is also of the type that is described in detail in the International patent application WO-95/28525, and for further details reference is made to the description contained therein. The difference lies in the construction of the levelling system.

In this embodiment the levelling system comprises three plates 50, 51 and 52. The two lateral plates 50 and 52 are mounted partially underneath central plate 51, the surface of central plate 51 bearing against the upper face of plates 50 and 52.

Central plate 51 is connected to four tube sections 55, 56, 57 and 58, whilst plates 50 and 52 are connected to tube sections 60, 61, and 62, 63 respectively, which interact telescopically with tube sections 55, 56, 57, 58. One end of tube sections 60, 61, 62, 63 is connected to frame sections 18 and 19 respectively. This structure ensures that when the working width of the machine increases or decreases due to lateral displacement of frame sections 18 and 19 relative to one another, plates 50 and 52 are displaced relative to plate 51. The working width of the labeling system is therefore also adapted.

The cross-sectional shape of plates 51 corresponds to the cross-sectional shape of plate 22, whilst the cross-sectional shape of plates 50 and 52 corresponds to the cross-sectional shape of plate 23. The advantage of this second embodiment lies in the fact that the machine can be widened on two sides and can therefore be kept symmetrical. This ensures more uniform operation of the machine.

In order to avoid that concrete will penetrate in the split between the two plates 22 and 23 at the underside where the plates overlap it is preferred to place a magnetic device 81 on top of the upper plate 22 at that separation line whereby the plates 22 and 23 are attracted to each other in order to close that gap. Preferably the magnetic device 81 is of the type normally used to lift steel or iron plates and which can be switched off and on by means of a lever. This allows that the magnetic device 81 can be easily placed at the right spot when the plates 22 and 23 are moved with respect to each other. In practise it is only required to have such a magnetic device at the location of the separation line between two superimposed horizontal plates and close to the tailing edge thereof.

In case of the embodiment shown in FIG. 5 two such magnetic devices 83 and 84 are required as in this embodiments there are three places which are cooperating in order to adjust the width of the path to be laid. In this embodiment therefore there are two gaps to be closed between the plates 50 and 51 and 51 and 52 respectively.

It is clear that the invention is not limited to the embodiments described and reproduced, but that a number of modifications can be carried out within the scope of the claim formulations.

The invention claimed is:

1. A machine for laying concrete paths of the type in which a concrete mix in the plastic state is spread over a certain width and is then levelled to a certain height, wherein a levelling element comprises at least first and second horizontal plates each having an upper and lower surface which are positioned at least partially laterally next to one another, viewed in the direction of movement of the machine, and which can be displaced in the lateral direction relative to each other for adjusting the working width of the machine, wherein the lower surface of said first plate overlaps and is in contact with the upper surface of the second plate such that said plates are slidable laterally relative to one another; and wherein the rear edges of the plates form the lowest line of the plates viewed in the direction of movement of the machine, and wherein the two rear edges are at the same height.

2. The machine according to claim 1, characterised in that the first plate has a rear section directed obliquely downwards, which section terminates at a rear edge that determines the desired levelling height, and in that the second plate is also provided with such a downwardly directed rear section, wherein the rear edge of the rear section of the second plate lies at the same height as the rear edge of the rear section of the first plate.

3. The machine according to claim 1, characterised in that the levelling element comprises three horizontal plates which are positioned at least partially laterally next to one another, viewed in the direction of movement of the machine, wherein the central plate is fixedly connected to the machine in the lateral direction, and wherein the two side plates can be displaced laterally relative to the central plate.

4. The machine according to claim 1, characterised in that a finishing plate is mounted behind the levelling system, viewed in the direction of movement of the machine, which finishing plate extends from the rear edge of the levelling system and runs obliquely downwards, viewed in the direction of movement of the machine.

5. The machine according to claim 4, characterised in that the finishing plate is connected in a hinged manner to the rear edge of the levelling system.

6. The machine according to claim 5, characterised in that the finishing plate is kept under pressure.

7. The machine according to claim 1, wherein a magnetic device is positioned on top of the upper face of each pair of horizontal plates to attract the plates to each other.

8. The machine according to claim 7, characterised in that the magnetic device can be switched off and on.

9. The machine according to claim 7, characterised in that the magnetic device is substantially located at the lower separation line between two superimposed plates.

10. The machine according to claim 1, characterised in that the levelling element comprises three horizontal plates which are positioned at least partially laterally next to one another, viewed in the direction of movement of the machine, wherein the central plate is fixedly connected to the machine in the lateral direction, and wherein the two side plates can be displaced laterally relative to the central plate.

11. The machine according to claim 2, characterised in that the levelling element comprises three horizontal plates which are positioned at least partially laterally next to one another, viewed in the direction of movement of the machine, wherein the central plate is fixedly connected to the machine in the lateral direction, and wherein the two side plates can be displaced laterally relative to the central plate.

12. The machine according to claim 1, characterised in that a finishing plate is mounted behind the levelling system, viewed in the direction of movement of the machine, which finishing plate extends from the rear edge of the levelling system and runs obliquely downwards, viewed in the direction of movement of the machine.

13. The machine according to claim 2, characterised in that a finishing plate is mounted behind the leveling system, viewed in the direction of movement of the machine, which finishing plate extends from the rear edge of the leveling system and runs obliquely downwards, viewed in the direction of movement of the machine.

14. The machine according to claim 3, characterised in that a finishing plate is mounted behind the leveling system, viewed in the direction of movement of the machine, which finishing plate extends from the rear edge of the leveling system and runs obliquely downwards, viewed in the direction of movement of the machine.

15. The machine according to claim 10, characterised in that a finishing plate is mounted behind the leveling system, viewed in the direction of movement of the machine, which finishing plate extends from the rear edge of the leveling system and runs obliquely downwards, viewed in the direction of movement of the machine.

16. The machine according to claim 11, characterised in that a finishing plate is mounted behind the levelling system, viewed in the direction of movement of the machine, which finishing plate extends from the rear edge of the levelling system and runs obliquely downwards, viewed in the direction of movement of the machine.

17. The machine according to claim 12, characterised in that the finishing plate is connected in a hinged manner to the rear edge of the levelling system.

18. The machine according to claim 13, characterised in that the finishing plate is connected in a hinged manner to the rear edge of the levelling system.

19. The machine according to claim 14, characterised in that the finishing plate is connected in a hinged manner to the rear edge of the levelling system.

* * * * *